US010508431B2

(12) United States Patent
Cole et al.

(10) Patent No.: US 10,508,431 B2
(45) Date of Patent: Dec. 17, 2019

(54) CLEAR DRUM COVERS FOR PLUMBING TOOLS

(71) Applicant: Ridge Tool Company, Elyria, OH (US)

(72) Inventors: Alex M. Cole, Columbia Station, OH (US); Michael J. Rutkowski, Locust Grove, VA (US)

(73) Assignee: RIDGE TOOL COMPANY, Elyria, OH (US)

( * ) Notice: Subject to any disclaimer, the term of this patent is extended or adjusted under 35 U.S.C. 154(b) by 333 days.

(21) Appl. No.: 15/420,550

(22) Filed: Jan. 31, 2017

(65) Prior Publication Data

US 2017/0268216 A1 Sep. 21, 2017

Related U.S. Application Data

(60) Provisional application No. 62/310,118, filed on Mar. 18, 2016.

(51) Int. Cl.

| | |
|---|---|
| ***B08B 9/045*** | (2006.01) |
| ***E03F 9/00*** | (2006.01) |
| ***E03C 1/302*** | (2006.01) |

(52) U.S. Cl.

CPC ..... *E03F 9/002* (2013.01); *B08B 9/045* (2013.01); *E03C 1/302* (2013.01); *E03F 9/005* (2013.01)

(58) Field of Classification Search

CPC ..... B08B 9/045; E03C 1/302; E03F 9/002; E03F 9/005

See application file for complete search history.

(56) References Cited

U.S. PATENT DOCUMENTS

| | | | | |
|---|---|---|---|---|
| 4,514,936 | A | 5/1985 | Hurtado | |
| 5,262,578 | A | 11/1993 | Hall | |
| 2008/0148503 | A1 | 6/2008 | Babb et al. | |
| 2010/0005603 | A1* | 1/2010 | Liu | B08B 9/0436 15/28 |

FOREIGN PATENT DOCUMENTS

| | | |
|---|---|---|
| CN | 101631918 | 1/2010 |
| WO | 2006075137 | 7/2006 |
| WO | 2008105628 | 9/2008 |

OTHER PUBLICATIONS

Chinese Office Action; Patent Application No. 201710117008.X; dated Jan. 16, 2019; 15 pages.

* cited by examiner

*Primary Examiner* — Randall E Chin

(74) *Attorney, Agent, or Firm* — Rankin, Hill & Clark LLP; Mark E. Bandy

(57) ABSTRACT

A clear or generally transparent cover or enclosure for plumbing tools is described. The clear cover enables viewing of interior regions of the plumbing tools. In particular versions, the covers are used with drum type drain cleaning devices and enable visual inspection of the drum and/or a flexible drain cleaning cable associated with the device.

12 Claims, 10 Drawing Sheets

CLEAR DRUM COVERS FOR PLUMBING TOOLS

CROSS REFERENCES TO RELATED APPLICATIONS

This application claims priority from U.S. provisional application Ser. No. 62/310,118 filed on Mar. 18, 2016.

FIELD

The present subject matter relates to clear or transparent covers for use with plumbing tools such as a drum type drain cleaning device.

BACKGROUND

Many types of plumbing tools are known which use a flexible cable or "snake". Such tools are used by selectively advancing or extending the cable from the tool into a drain or piping system which is clogged. The cable is retracted and typically stored in the tool by winding the cable about a rotatable drum within the tool.

It is often desirable to view the cable and/or drum, particularly during use of the tool. However, due to rotation of the drum and movement of the cable as it is wound about the drum, such components are typically housed within an enclosure to contain water and/or debris carried from the drain or clogged piping system, and thereby prevent the water/debris from contacting an operator. Such enclosures obscure drum and cable and preclude the operator from viewing such.

Accordingly, due to these and other concerns, a need exists for drum type plumbing tools that enable visual inspection of their drums and cables, while also shielding an operator from contact with water/debris carried from a drain or other site.

SUMMARY

The difficulties and drawbacks associated with previous approaches are addressed in the present subject matter as follows.

In one aspect, the present subject matter provides a cylindrical cover adapted for use with a drum type drain cleaning machine having a drain cleaning cable. The cover is configured and positioned on the machine to enable visual inspection of the drain cleaning cable.

In another aspect, the present subject matter provides a plumbing tool having a drain cleaning cable and a cover positioned over at least a portion of the drain cleaning cable, wherein the cover is clear to enable visual inspection of the drain cleaning cable.

In yet another aspect, the present subject matter provides a drum type drain cleaner including a rotatable drum and flexible drain cleaning cable that can be selectively advanced or retracted relative to the drum. The drain cleaner also includes an outer cover that generally encloses the drum and at least a portion of the drain cleaning cable, wherein the cover is sufficiently clear or transparent to enable viewing of the drain cleaning cable through the cover.

In still another aspect, the present subject matter provides a drum type drain cleaner comprising a housing generally enclosing a motor, at least one base member disposed along a lower region of the housing, a rotatable drum rotatably powered by the motor, an outer drum housing disposed about the drum, and a drum cover disposed about the outer drum housing. The drum cover includes at least one region that is visually clear to thereby enable visual inspection of the outer drum housing through the region.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

Figure 1:
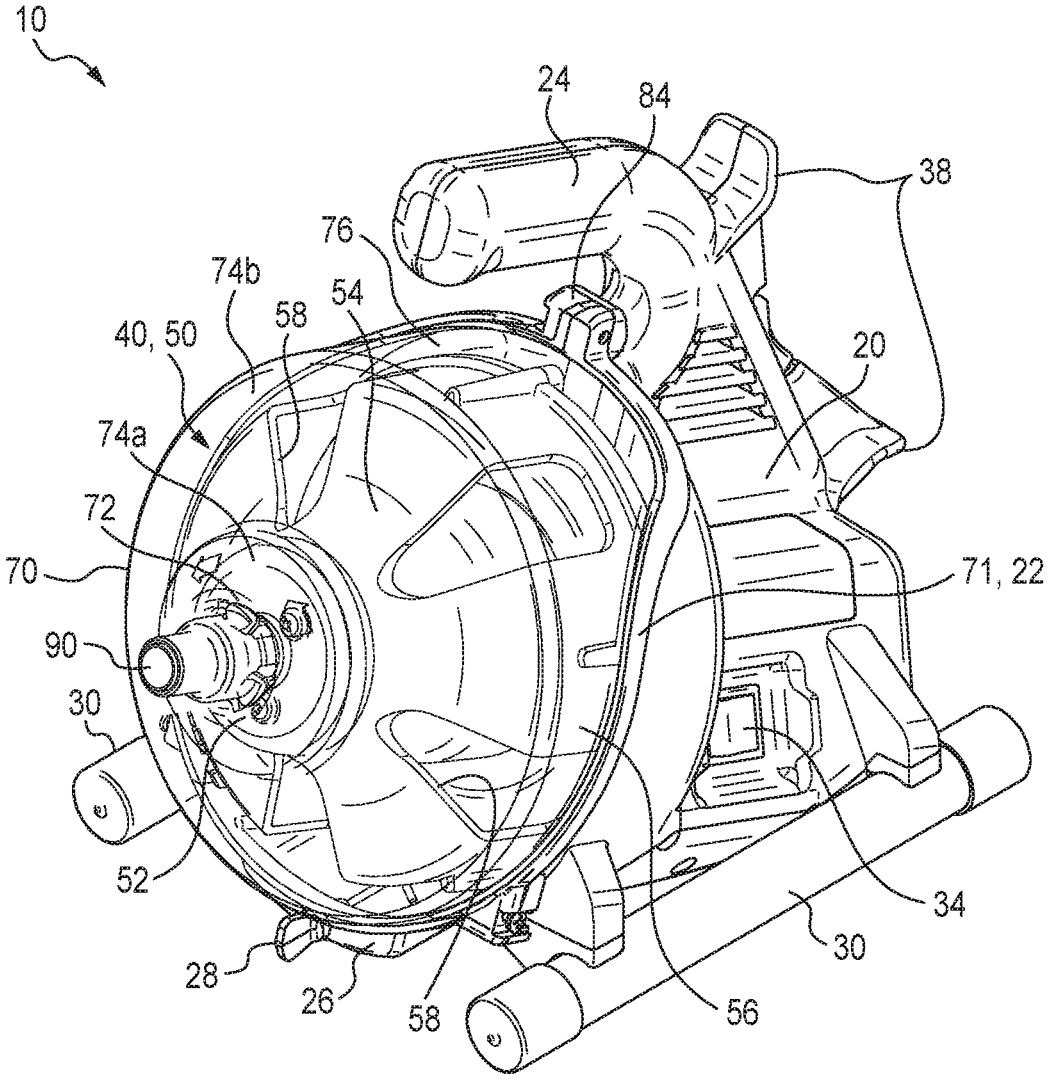
FIG. 1 is a perspective view of a drum type drain cleaner with a clear drum cover in accordance with the present subject matter.
Figure 2:
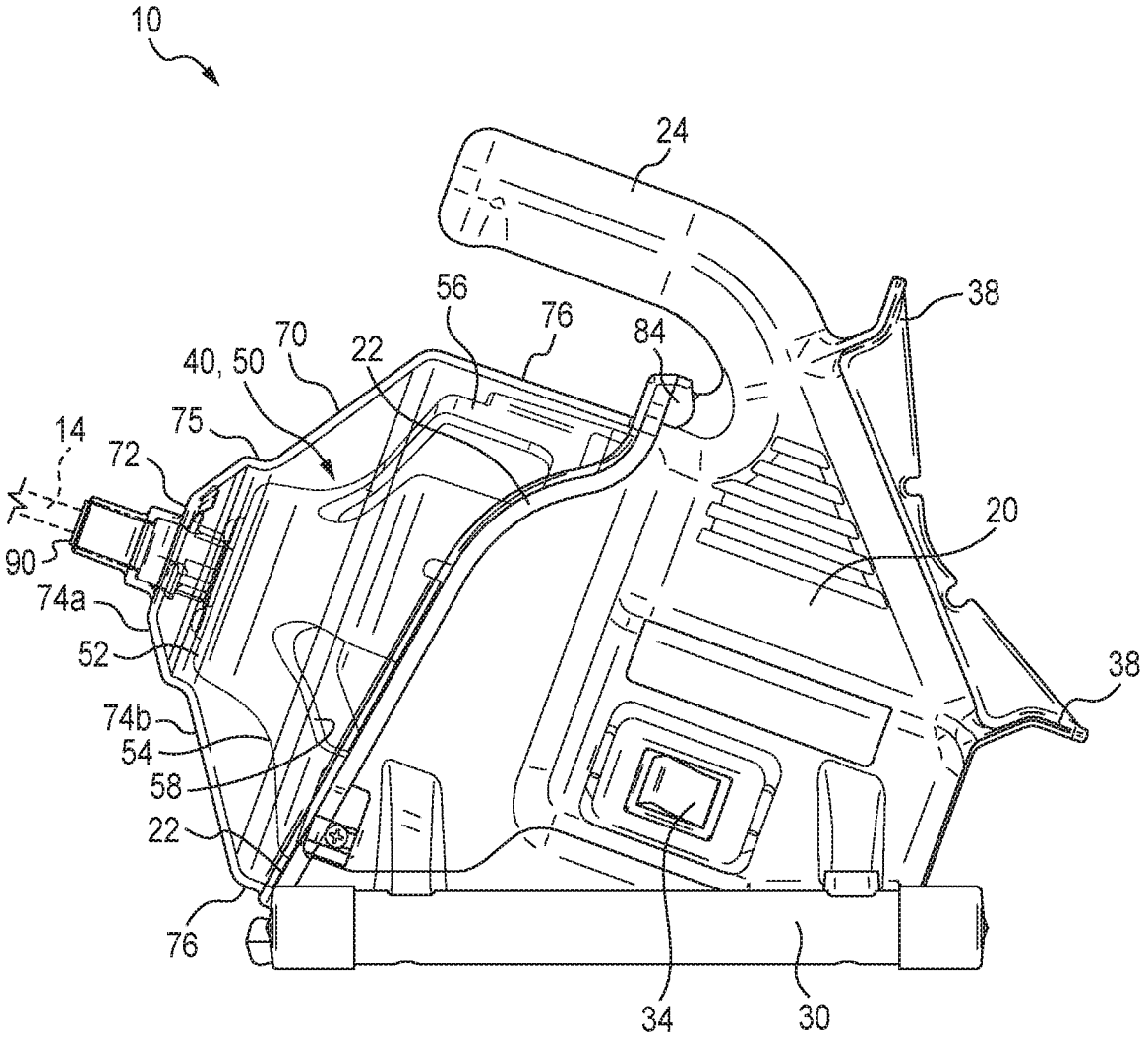
FIG. 2 is a side elevational view of the drum type drain cleaner with a clear drum cover shown in FIG. 1.

The present subject matter provides covers or housings for plumbing tools that enable viewing or visual inspection of the interior of the tool. In a particular aspect, a clear cover for a drum type drain cleaning machine is provided that allows an operator to view the drum and/or a flexible drain cleaning cable (also known in the art as a "snake") typically stored or otherwise retained in the machine.

Clear or transparent covers for a drum type drain cleaning machine are provided. The clear drum cover allows for an operator to visually inspect a drain cleaning cable contained in an open drum without removing the drum or cover from the machine. The clear drum cover also allows an operator to determine how much usable cable is in the drum while using the tool. Dirt and debris are contained within the machine as the open drum spins and centrifugal force expels the water from the drum into the housing. With a nontransparent cover the dirt and debris would be contained, but the operator would not be able to see into the drum.

The clear drum covers of the present subject matter may be provided in a wide array of shapes and/or sizes. In many versions, the drum covers are cylindrical in shape or at least include a region or portion of the cover that is cylindrical such as a rearward circumferential portion.

More specifically, the present subject matter provides a clear cover located over an open style drum which is contained in the machine housing. The drum is supported by the machine housing and optionally, also supported by the clear cover. Any material brought back from the cable is spun out of the drum and into the housing. The clear cover houses the drum in order to keep the surrounding area external to the machine clean. A drain plug on the machine allows for excess water to be drained while the machine is being used. As water accumulates in a housing reservoir located in a lowermost region of the machine, the operator can visually see when the machine is to be drained.

The cover provides visibility into the front and outer circumference of the drum so an operator is able to see how much usable cable is left in the drum. Any issues with the drum or cable inside the drum can also be seen by the operator allowing for corrective action. If the cable were to "load up" or otherwise excessively accumulate or wind improperly on the drum the situation can be seen by the operator.

Affixing the clear cover to the machine housing can be achieved with a variety of different methods and/or components to allow for easy removal when cleaning the drum, cover, and/or cable. One technique involves an over-center clamp or latch which when engaged brings the housing and cover together in a rigid holding state. Another technique uses a screw and slot configuration in order to avoid having to completely remove the screw to free the cover. The screws can be used with a traditional drive which requires a tool, or they may be of a design which can be removed using fingers only. Captive screws fixed to the cover can be utilized to make for easy removal of the cover.

In certain embodiments, the entire drum cover is clear. Variations of this configuration can include a partially clear cover in which one or more area(s) or region(s) of the cover is clear to see the drum while the remaining area or region of the cover is opaque. The present subject matter also includes the use of a clear window in the drum housing. As described herein, typically the drum cover encloses an outer drum housing which encloses or at least partially surrounds the drum about which the drain cleaning cable is wound. When the drum is not enclosed by a cover, a clear drum housing can be utilized in order to visually inspect the drum and/or the drain cleaning cable when openings in the drum housing are not possible.

In the descriptions herein of various embodiments of drum covers, drum housings and drain cleaners using such, the drum covers and/or housings are noted as being "clear" or having one or more wall regions which are clear. The use of such clear covers/housings or wall regions in covers/housings enables visual inspection of interior(s) or portion(s) of the covers/housings. The term "clear" as used herein refers to a level or extent of transparency to visual light at conditions of typical use of the drain cleaners without excessive obscuring of the cover interior, housing interior, or components therein. In certain embodiments, the term "clear" can be expressed by transmittance percentages of visual light as measured by a spectrophotometer for example. In particular embodiments, the term clear refers to a transmittance of visual light of at least 50%, of at least 60%, of at least 70%, of at least 80%, of at least 90%, of at least 95%, of at least 98%, and in other specific embodiments of at least 99%.

FIGS. 1-4 illustrate an embodiment of a drum type drain cleaner 10 in accordance with the present subject matter. The cleaner 10 generally comprises a housing 20, one or more base member(s) 30 along a lower region of the housing for contacting a floor or ground and supporting the cleaner, a rotatably powered drum 40 disposed within an outer drum housing 50, and a clear drum cover 70. The housing 20 provides a support ledge 22 which is configured to matingly engage an edge 71 of the drum cover 70, and in certain versions sealingly engage the edge 71 of the drum cover 70. As will be appreciated, a drain cleaning cable 14 is at least partially housed or stored by the drum 40 and outer drum housing 50. Rotation of the drum 40 in conjunction with a cable feed apparatus (not shown) results in administration of the cable 14 out of the drum assembly 40, 50; or retraction into the drum assembly.

The housing 20 generally encloses a motor (not shown) which is typically an electrically powered motor having a rotary output for providing powered rotation of the drum 40 and associated components. Also provided with and/or integrally formed with the housing 20 is a handle 24 that in many embodiments extends over a center of mass of the cleaner 10 to facilitate carrying or lifting of the cleaner 10 by an operator. The housing 20 can also include a sump 26 or other housing reservoir with a drain or removable plug 28. The sump 26 is typically in the form of a lowermost enclosed region of the housing 20 disposed below the drum 40 that serves to collect moisture, water, and debris. The drain 28 facilitates removal of such moisture, water, and/or debris from the sump 26, and specifically from an interior region of the sump 26.

The drain cleaner 10 typically additionally includes one or more controls and/or actuators 34 for governing or monitoring operation of the cleaner. The drain cleaner 10 may optionally include cord wrap provisions 38. In certain embodiments, the drain cleaner 10 may also include one or more provisions that provide feedback to an operator such as lights and/or gauges (not shown).

As will be understood, the drum 40 is rotatably powered by the motor and is typically in the form of a spool or cylinder. However, the present subject matter includes the use of other drum configurations such as for example, open frame carriages, polygonal configurations, and the like.

Figure 3:
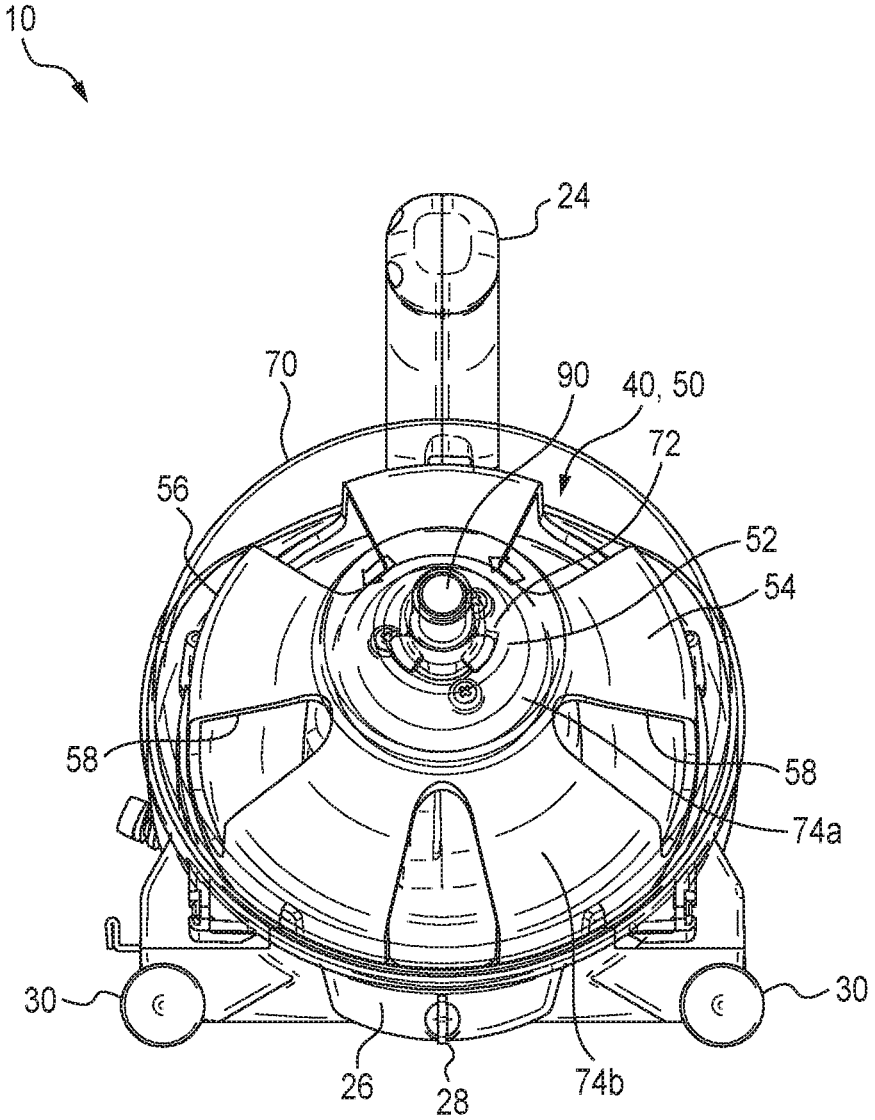
FIG. 3 is a front view of the drum type drain cleaner with a clear drum cover shown in FIG. 1.
Figure 4:
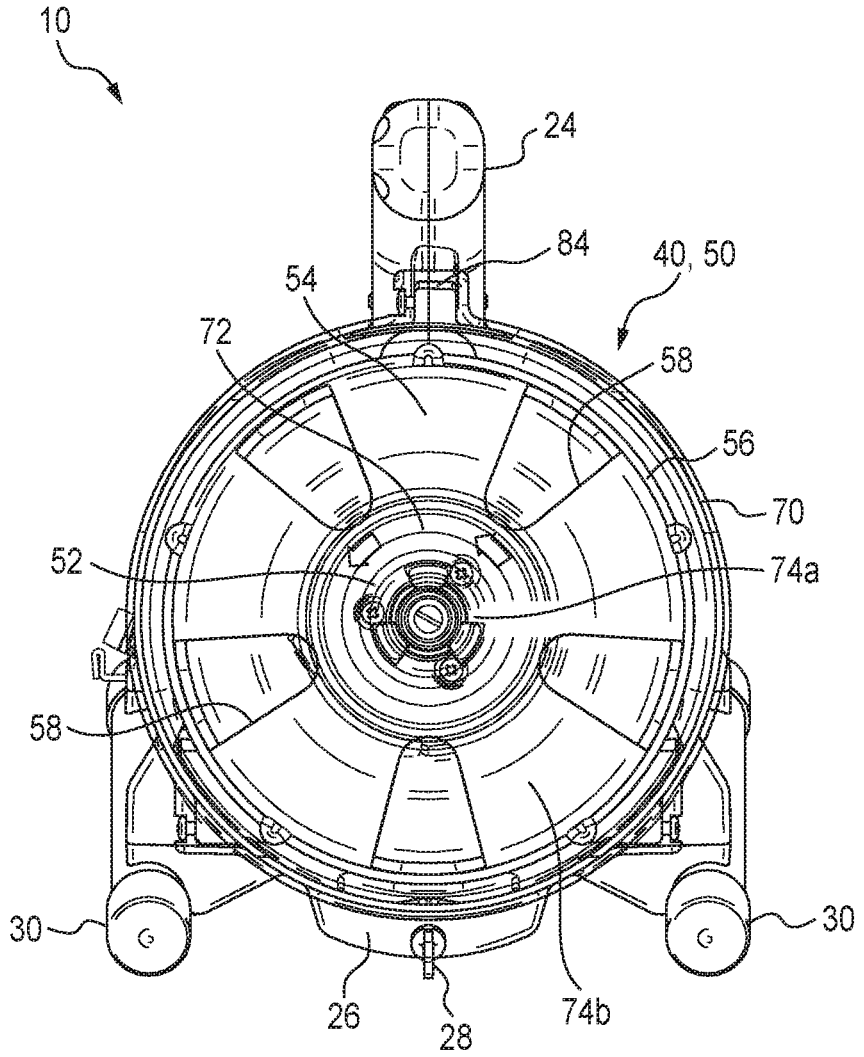
FIG. 4 is another front view of the drum type drain cleaner with a clear drum cover shown in FIG. 1.

The drain cleaner 10 also includes the noted outer drum housing 50. The outer drum housing 50 defines a front 52, a rearwardly extending circumferential wall 56, and in many versions, an arcuate wall 54 extending between the front 52 and the circumferential wall 56. In many embodiments, the outer drum housing 50 defines one or more openings 58 which enable visual inspection of the drum 40 and/or a drain cleaning cable 14 generally disposed within the housing 50. The outer drum housing 50 depicted in the referenced figures is an example of an open drum housing. In certain versions of the outer drum housing 50, the housing defines a plurality of openings 58 and particularly at least two openings, at least three openings, at least four openings, at least five openings such as shown in FIG. 3, and in particular versions six or more openings. The present subject matter includes the use of one or more viewing windows instead of, or in addition to, the noted openings.

The drain cleaning 10 also comprises a clear drum cover 70. The drum cover 70 is clear or as explained in greater detail herein, includes at least one region such as a wall region, that is sufficiently visually clear to thereby enable visual inspection of the outer drum housing 50 through the drum cover 70. And in many versions, the drum 40 and/or drain cleaning cable 14 can be seen through the outer drum housing 50 and/or openings defined in the housing 50. The drum cover 70 includes a front 72, a rearwardly extending circumferential wall 76, and one or more wall regions extending between the front 72 and the circumferential wall 76. In certain versions, the one or more wall regions include a first conical wall **74*a* generally extending from and disposed immediately alongside the front 72, a second conical wall 74*b* generally extending from and disposed immediately alongside the circumferential wall 76, and a connecting ring wall portion 75 extending between the first conical wall 74*a* and the second conical wall 74*b*. It will be understood that in no way is the present subject matter limited to drum covers such as cover 70 having the particular configuration as described. Instead, the present subject matter includes a wide array of shapes, sizes, and configurations of the drum cover 70**.

In the particular embodiment depicted in FIGS. 1-4, the entirety of the drum cover 70 is clear. This greatly facilitates easy and extensive visual inspection of the drum and cable by an operator from nearly any position relative to the drain cleaner 10. However, it will be understood that the present subject matter includes the use of drum covers 70 that are not clear at all regions of the cover. Thus, in these versions the drum covers have clear regions that constitute less than 100% of the total surface area of the drum cover. The present subject matter includes drum covers having clear region(s) that constitute less than 95%, less than 90%, less than 80%, less than 70%, less than 60%, less than 50%, less than 40%, less than 30%, less than 20%, and less than 10% of the total surface area of the drum cover. The drum covers of the present subject matter may include clear regions that constitute at least 10%, at least 20%, at least 30%, at least 40%, at least 50%, at least 60%, at least 70%, at least 80%, at least 90%, and in certain versions at least 95% of the total surface area of the drum cover. The present subject matter also includes the use of drum housings having one or more of these extents of clear regions of the housing.

The drain cleaner 10 also includes a cable port 90 through which the drain cleaning cable 14 is accessed. Typically, the port 90 is concentrically located and aligned with an axis of rotation of the drum 40.

As noted, the clear drum cover 70 is releasably attached to the housing 20 or other component(s) of the drain cleaner 10 by one or more cover affixment provisions such as 84 shown in the referenced figures. The cover affixment provisions can for example, be in the form of an over-center clamp or latch and/or use screw(s) as previously described.

Figure 5:
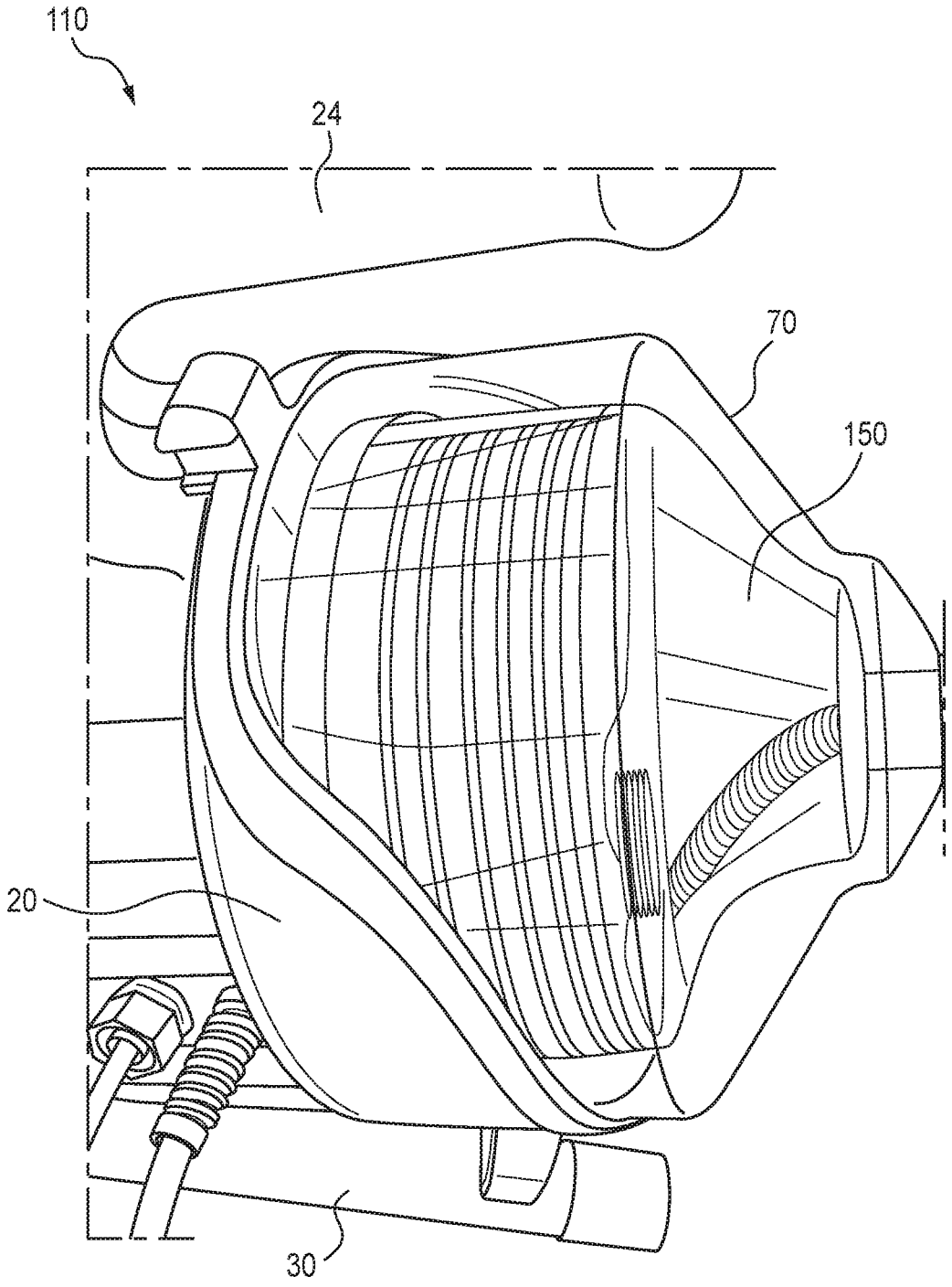
FIG. 5 is a view of another embodiment of a drum type drain cleaner having a clear drum cover in accordance with the present subject matter.
Figure 6:
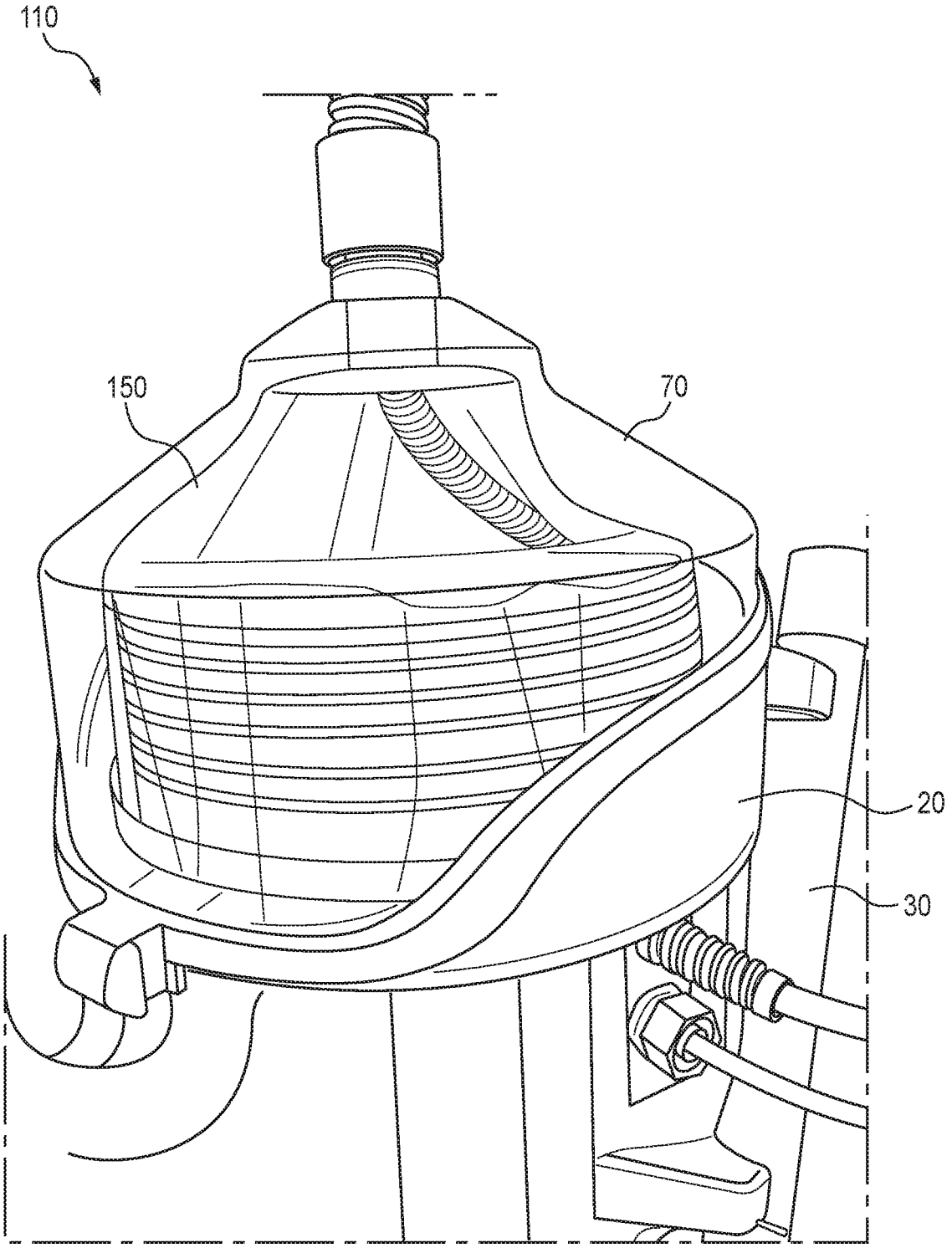
FIG. 6 is a side view of the clear drum cover depicted in FIG. 5.

FIGS. 5-6 illustrate another embodiment of a drain cleaner having a closed outer drum housing and a clear drum cover in accordance with the present subject matter. In this version of the present subject matter, a drum type drain cleaner 110 is provided which instead of using an open drum housing such as housing 50 depicted in FIGS. 1-4, utilizes a closed drum housing 150 which is clear. The drain cleaner 110 includes the same components as previously described cleaner 10, but for the closed clear drum housing 150. The use of a clear drum housing 150 and a clear drum cover 70, enables visual inspection of the interior of the housing 150 in which are disposed the drum and a drain cleaning cable.

Figure 7:
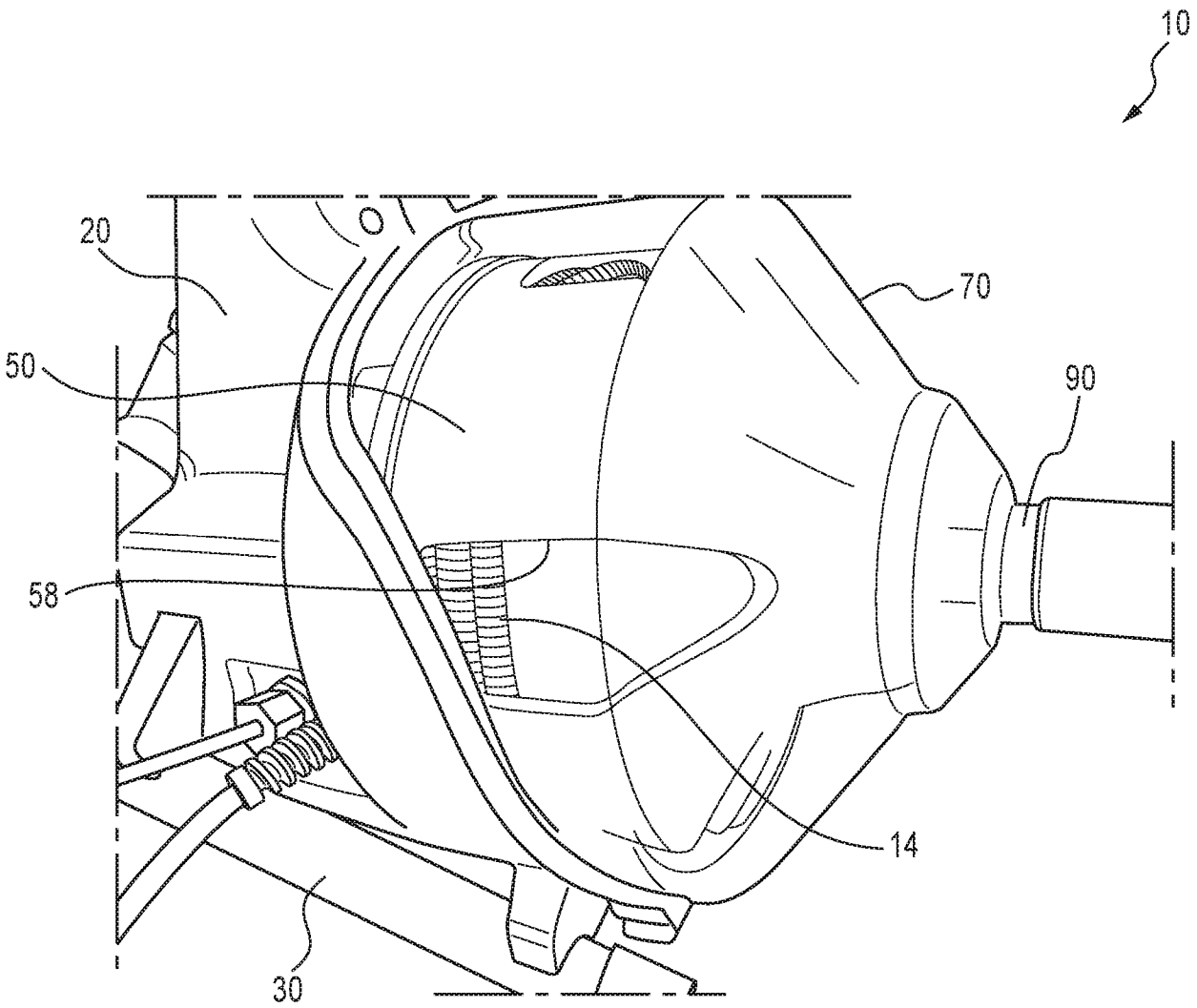
FIGS. 7 to 9 are views of the drum type drain cleaner having a clear drum cover of FIGS. 1-4 showing varying amounts of cable on a drum.
Figure 8:
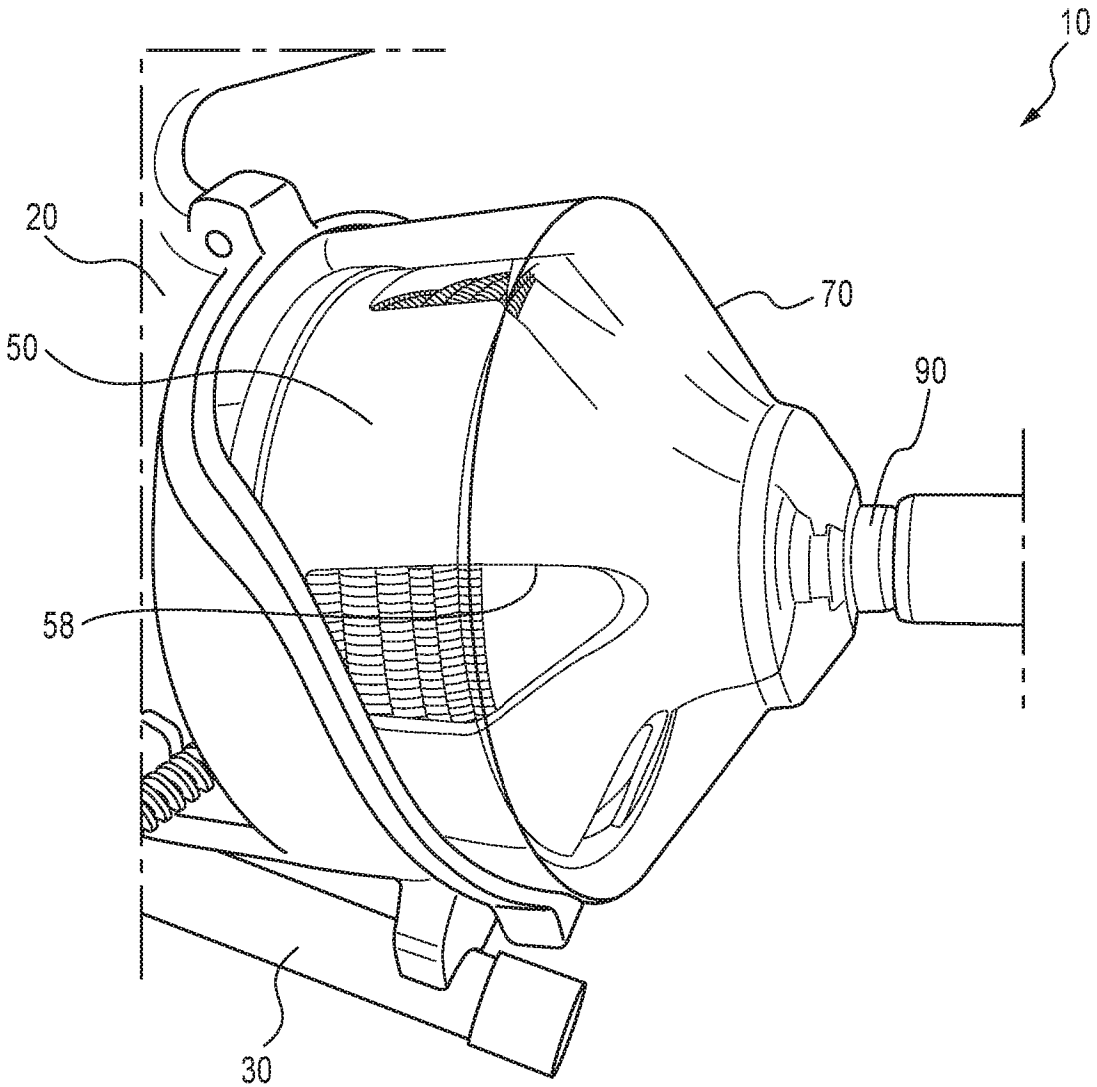
Figure 9:
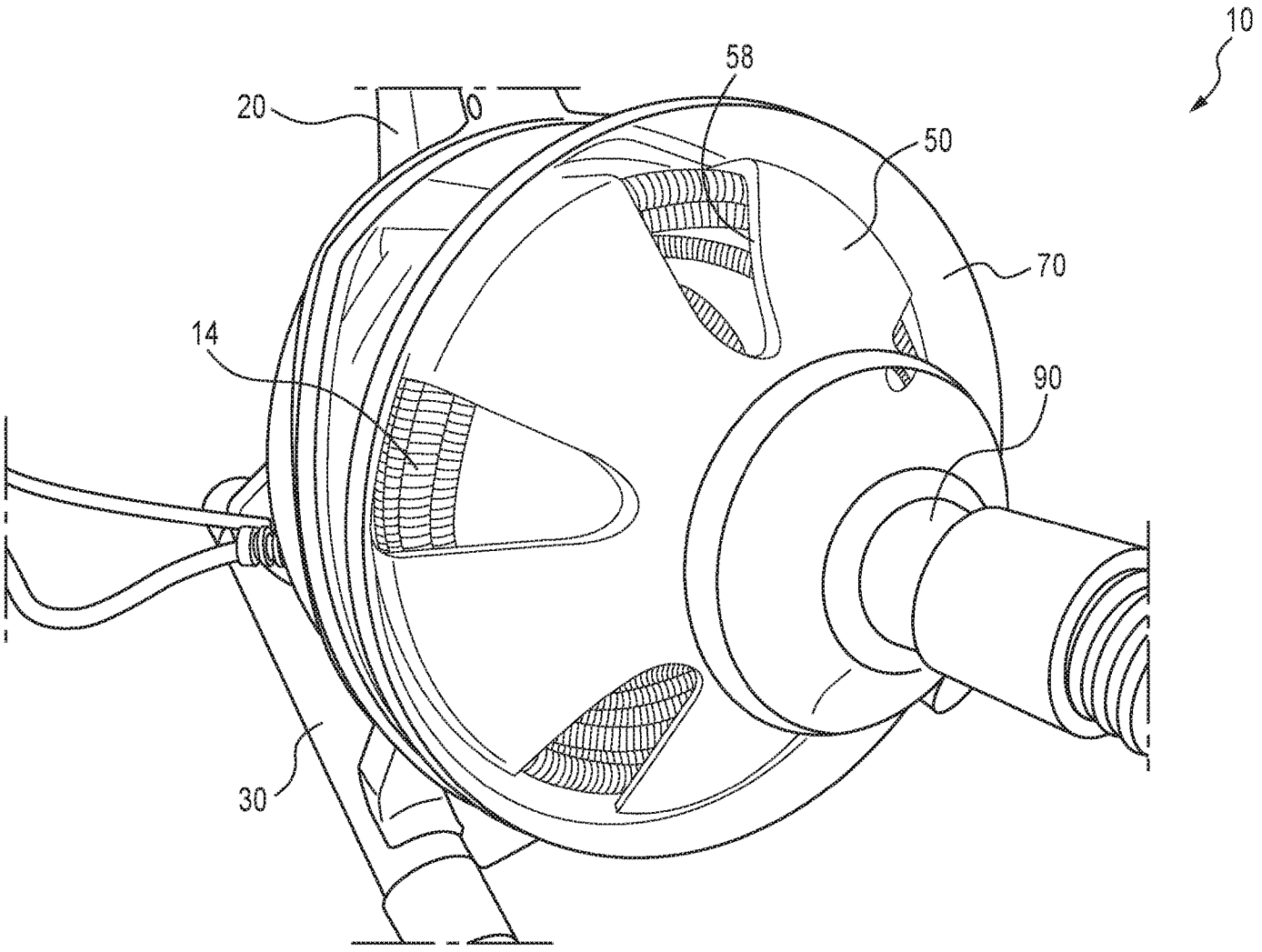

FIGS. 7-9 illustrate the drain cleaner 10 described in conjunction with FIGS. 1-4. FIGS. 7-9 depict the drain cleaner 10 having varying or different lengths of a drain cleaning cable 14 wound around the drum 40, and which are viewable through openings 58 in the outer drum housing 50.

Figure 10:
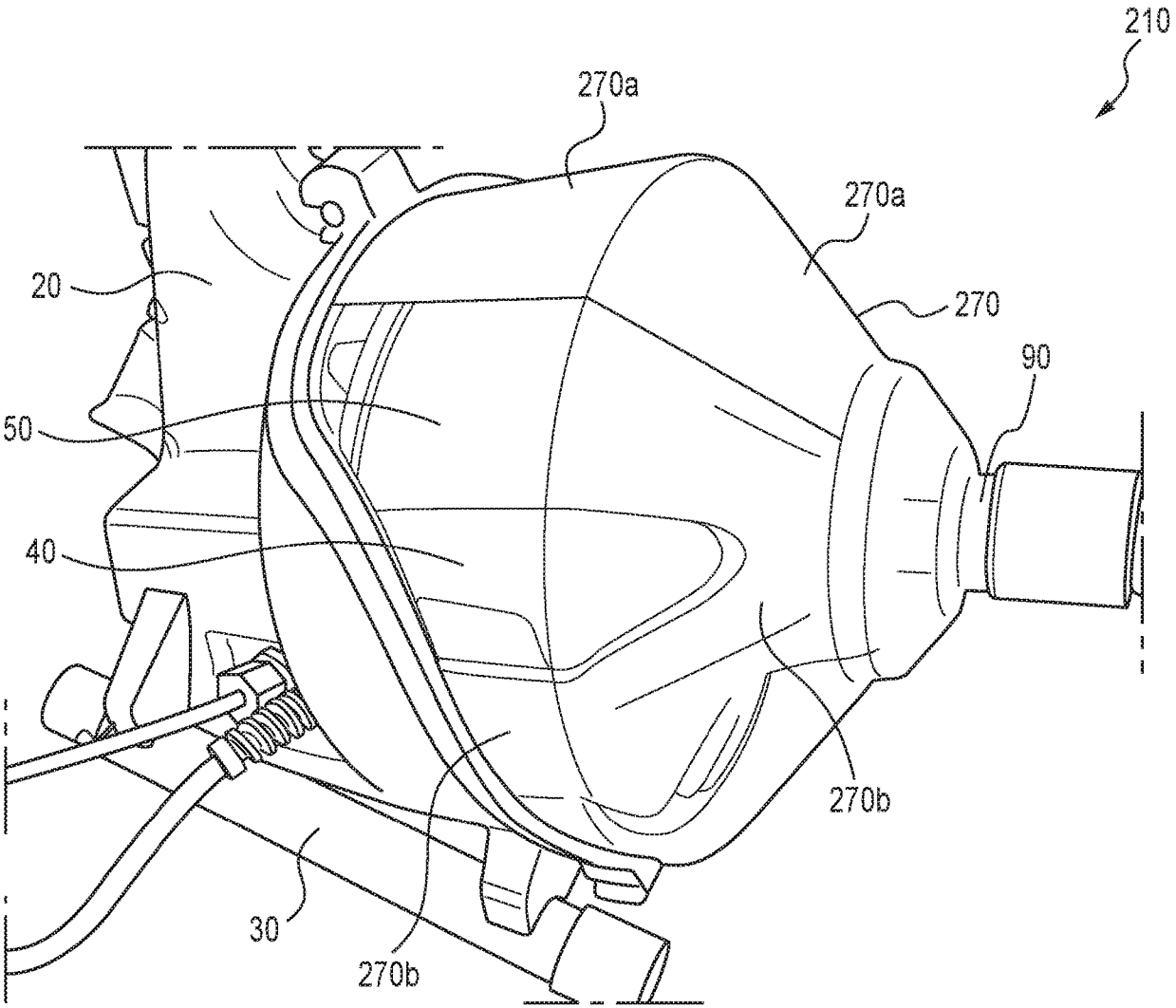
FIG. 10 is a view of still another embodiment of a drum type drain cleaner having a clear drum cover in accordance with the present subject matter.

FIG. 10 illustrates another embodiment of a drum type drain cleaner 210 in accordance with the present subject matter. The drain cleaner 210 includes a drum cover 270 having one or more opaque regions such as 270*a*, and one or more clear regions 270*b*. The interior of the drum cover 270 can be viewed through the clear regions 270*b*, but can not be viewed through the opaque regions 270*a*. The remaining components of the drain cleaner 210 are as described in association with the previously addressed drain cleaner 10.

The clear drum covers, clear drum housings, and/or clear viewing windows provided in drum covers and/or drum housings can be formed from a wide array of materials. In many embodiments, the material is a clear plastic material such as, but not limited to, polycarbonate (typically commercially available under the trade designation LEXAN); poly(methyl methacrylate) (typically also known as PMMA and commercially available under the trade designations PLEXIGLASS, ACRYLITE, LUCITE, and PERSPEX for example); styrene-based plastics such as styrene acrylonitrile for example; and glycol modified polyethylene terephthalate (PETG). It will be understood that the present subject matter is not limited to any of these particular materials and includes others so long as sufficiently clear and durable to withstand typical use conditions associated with drain cleaners.

Many other benefits will no doubt become apparent from future application and development of this technology.

All patents, applications, standards, and articles noted herein are hereby incorporated by reference in their entirety.

The present subject matter includes all operable combinations of features and aspects described herein. Thus, for example if one feature is described in association with an embodiment and another feature is described in association with another embodiment, it will be understood that the present subject matter includes embodiments having a combination of these features.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. In combination with a drum type drain cleaner including a rotatable drum and a flexible drain cleaning cable that can be selectively advanced or retracted relative to the drum, a cover configured to generally enclose the drum and at least a portion of the drain cleaning cable, wherein the cover is clear or sufficiently transparent for enabling viewing of the drain cleaning cable through the cover.

2. A drum type drain cleaner comprising:

a housing generally enclosing a motor;

at least one base member disposed along a lower region of the housing;

a rotatable drum rotatably powered by the motor;

an outer drum housing disposed about the drum;

a drum cover disposed about the outer drum housing, the drum cover having at least one region that is visually clear to thereby enable visual inspection of the outer drum housing through the region.

3. The drum type drain cleaner of claim 2 wherein the housing includes a sump disposed below the drum.

4. The drum type drain cleaner of claim 3 wherein the sump includes a drain for selective access to an interior region of the sump.

5. The drum type drain cleaner of claim 2 wherein the outer drum housing defines at least one opening sized and located to enable visual inspection of at least one of (i) the drum, and (ii) a drain cleaning cable.

6. The drum type drain cleaner of claim 5 wherein the outer drum housing defines a front, a circumferential wall, and an arcuate wall extending between the front and the circumferential wall.

7. The drum type drain cleaner of claim 2 wherein the outer drum housing is closed and free of openings defined in the outer drum housing, the outer drum housing including at least one region that is visually clear to enable visual inspection of at least one of (i) the drum, and (ii) a drain cleaning cable.

8. The drum type drain cleaner of claim 7 wherein the entire outer drum housing is visually clear.

9. The drum type drain cleaner of claim 2 wherein the drum cover includes a front, a circumferential wall, and at least one wall region extending between the front and the circumferential wall.

10. The drum type drain cleaner of claim 2 wherein the at least one region that is visually clear exhibits a transmittance of at least 50%.

11. The drum type drain cleaner of claim 2 wherein the at least one region that is visually clear exhibits a transmittance of at least 90%.

12. The drum type drain cleaner of claim 2 wherein the entire drum cover is visually clear.

* * * * *